United States Patent [19]

Fisher et al.

[11] 4,049,053

[45] Sept. 20, 1977

[54] RECOVERY OF HYDROCARBONS FROM PARTIALLY EXHAUSTED OIL WELLS BY MECHANICAL WAVE HEATING

[76] Inventors: Sidney T. Fisher, 53 Morrison Ave.; Charles B. Fisher, 2850 Hill Park Road, both of Montreal, Quebec, Canada

[21] Appl. No.: 694,700

[22] Filed: June 10, 1976

[51] Int. Cl.[2] ..... E21B 43/24; E21B 43/25

[52] U.S. Cl. ..... 166/249; 166/177; 166/272; 166/302

[58] Field of Search ..... 166/249, 272, 302, 303, 166/305 R, 177; 299/14

[56] References Cited

U.S. PATENT DOCUMENTS

| | | | |
|---|---|---|---|
| 2,670,801 | 3/1954 | Sherborne | 166/249 |
| 2,866,509 | 12/1958 | Brandon | 166/177 |
| 2,918,126 | 12/1959 | Bodine | 166/249 |
| 3,016,095 | 1/1962 | Bodine | 166/177 |
| 3,048,226 | 8/1962 | Smith | 166/249 X |
| 3,133,591 | 5/1964 | Brandon | 166/249 |
| 3,378,075 | 4/1968 | Bodine | 166/177 X |
| 3,520,362 | 7/1970 | Galle | 166/249 |
| 3,754,598 | 8/1973 | Holloway, Jr. | 166/249 |
| 3,952,800 | 4/1976 | Bodine | 166/249 |

*Primary Examiner*—Stephen J. Novosad
*Assistant Examiner*—George A. Suchfield
*Attorney, Agent, or Firm*—Barrigar & Oyen

[57] ABSTRACT

Underground viscous hydrocarbon deposits, such as the viscous residues in conventional oil wells, are heated by mechanical wave energy to fluidize the hydrocarbons thereby to facilitate extraction thereof. For uniform, circular, symmetrical dispersion of mechanical wave energy of high-power and low-frequency, a mechanical wave energy radiator is provided comprising a cylindrical elastic tube of springy steel or the like preferably dimpled or corrugated and closed at one end and containing a liquid medium. Mechanical wave energy is applied to the liquid medium by a reciprocating source or the like connected to the radiator by a rigid walled tubular pipe or the like. The axial length of the radiator tube should be an odd multiple of one-quarter wavelength of the mechanical wave energy transmitted. Cavitation within the liquid is avoided by biasing the system with a steady state pressure at least as great as the maximum negative pressure swing of the mechanical waves in the liquid. Transformers are disclosed for accommodating changes in pipe diameter and changes in liquid medium throughout the system.

13 Claims, 10 Drawing Figures

RECOVERY OF HYDROCARBONS FROM PARTIALLY EXHAUSTED OIL WELLS BY MECHANICAL WAVE HEATING

BACKGROUND OF THE INVENTION

This invention relates to the mechanical wave heating of residual hydrocarbons in partially exhausted oil wells, or other viscous hydrocarbons located underground, for the purpose of reducing their viscosity and thus facilitating their extraction.

Liquid petroleum is conventionally obtained by drilling into oil-bearing strata, the bore-hole being lined with steel pipe which typically is from four to ten inches in inside diameter. Where the bore-hole passes through oil bearing sand or porous rock layers, the walls of the pipe are pierced to permit the oil, under the formation pressure, to flow into the pipe and so to the surface. Water is conventionally injected into the formation at high pressure through adjacent wells, and when the natural artesian pressure of the formation becomes insufficient this added pressure serves to force the oil to the surface. The depth of the wells typically ranges from 1500 to 15,000 feet or more. This method generally serves to extract of the order of one-third of the deposit, the remaining two-thirds being too viscous to flow at the temperature of the formation. Several methods are now in use to salvage part of this residue. These include injection of steam into the oil-bearing formation, and although costly this serves to recover perhaps another 15 to 20 percent of the deposit. Other methods that have been used without marked success include injection of solvents, electrical conduction heating, and heating by combustion of the formation, brought about by injecting air or oxygen.

At best the application of any known method of secondary recovery results in the raising of the recovery proportion from about one-third to about one-half, and in many cases at an uneconomical cost for this one-sixth of the deposit.

If a suitable heating technique were utilized in association with such "exhausted" liquid petroleum oil wells to raise the temperature of the residual underground petroleum deposits, the raising of the temperature of these deposits would be expected to reduce the viscosity of the petroleum to permit further recovery of petroleum from such wells could be economically realized. The problem heretofore experienced in the industry is that economically viable heating techniques have been difficult, if not impossible to realize in such wells. The residues are relatively inefficient thermal conductors, and of course it is necessary to heat an appreciable volume of the residues, without destruction or consumption thereof, if any given heating technique is to have any reasonable commercial prospects.

SUMMARY OF THE INVENTION

The present inventors have recognized that some extraction techniques for recovery of residual petroleum deposits from partially exhausted oil wells and the like would be much more satisfactory if there were a satisfactory method of heating a sufficiently large volume of the petroleum residues in situ, without undue consumption or destruction (as by burning, carbonizing, etc.) of the petroleum. The present invention accordingly has as its principal object the provision of a method of heating a selected portion of petroleum residues in situ without undesired combustion in situ of the constituent hydrocarbons, within the limits imposed by the nature of the constituents of the deposit, the surrounding environment, and the equipment used.

The present invention is the mechanical wave heating of a selected portion of an underground residual petroleum deposit or the like, especially a residual petroleum deposit located in the vicinity of a partially exhausted oil well.

At sufficiently elevated temperature (this will depend upon the viscosity of the constituents but an upper temperature in the range 200° to 400° F or even higher in the case of representative deposits may be expected) the petroleum residue either alone or in combination with other materials in the deposits becomes fluid. It can then be pumped out of the well. The pumping-out may be facilitated by the application of a fluid under pressure, such as steam, water or an inert gas, to the deposit so as to force the fluidized portion of the deposit to the well shaft and thence to the surface. The industry now uses a number of such techniques to help force oil to the surface, and the existing techniques can be applied mutatis mutandis to petroleum residues in partially exhausted wells, once the residues reach the desired degree of fluidity. The present invention is not primarily directed to the extraction process which follows the heating of the underground deposit; the present invention is primarily directed to the mechanical wave heating technique per se, which will then be followed or accompanied by a suitable extraction process. (It is contemplated that the heating may continue during at least some portion of the time required for extraction of the petroleum). However, possible extraction techniques will be described for use in conjunction with the invention and in a secondary aspect the invention embraces the combination of extraction techniques with the mechanical wave heating technique.

The mechanical wave heating may conveniently by implemented by means of a mechanical wave radiator located in a well communicating with the selected portion of the deposit to be heated. The radiator radiates mechanical wave energy directly from its location within the well to the selected portion of the deposit. To this end, the radiator may be immersed either directly in the petroleum residue or in suitable oil or other fluid medium which in turn is in direct physical contact with the residue. The radiator should preferably be capable of radiating the energy to the surrounding medium in a wide radiation pattern. The terms "radiate" and "radiation" must be understood, in relation to mechanical wave phenomena, as referring to wave phenomena in a material medium.

The required mechanical wave radiator for dispersing mechanical wave energy in a circular symmetrical configuration may conveniently be in the form of a cylindrical tube, preferably a thin metal hollow circular structure which contains a liquid medium. The tube is closed at one end and coupled at the other end to a source of mechanical wave energy. The closed end is made preferably of rigid reflecting material such as relatively thick steel. The side walls of the tube, however, are made of elastic material, such as a springy steel, for oscillatory deflection in response to the application of mechanical wave energy from the source to the working liquid within the tube. The side walls may, if desired, be corrugated parallel to the cylindrical axis of the tube to increase the effective radiating surface and improve the capability of the side walls to deflect radially, and in any event must be designed to yield sufficiently to transfer energy into the surrounding medium. The axial length of the radiator should be an odd multiple of one-quarter wave length of the mechanical waves being radiated so that the radiator behaves as a resonant element.

The source of mechanical waves can conveniently be a reciprocating piston whose output may be transmitted within a rigid tubular pipe, acting as a transmission line, to the open end of the radiator tube.

If for some reason the working fluid within the tube is to be different from the working fluid within the transmission line, a piston working in a cylinder serially connected in the transmission line can separate the two fluids from one another and transmit the mechanical wave energy from one fluid medium to the other. The piston behaves as a transformer for the mechanical wave energy. Such a transformer can be included elsewhere in the system if required. Another type of transformer comprises a tapered tubular section for connecting transmission line sections of different diameters. Still another type of transformer comprises a pair of rigidly interconnected pistons working in cylinders (e.g. transmission line sections) of different diameters.

In order to avoid internal energy losses due to cavitation, a bias pressure can be supplied to the working liquid. The bias pressure, for example, could be supplied via an air pressure tank located above and communicating through a small opening with the transmission line, the lower part of the air tank being occupied by some of the working liquid of the transmission line so that air is prevented from entering the transmission line.

DETAILED DESCRIPTION WITH REFERENCE TO DRAWINGS

Figure 1:
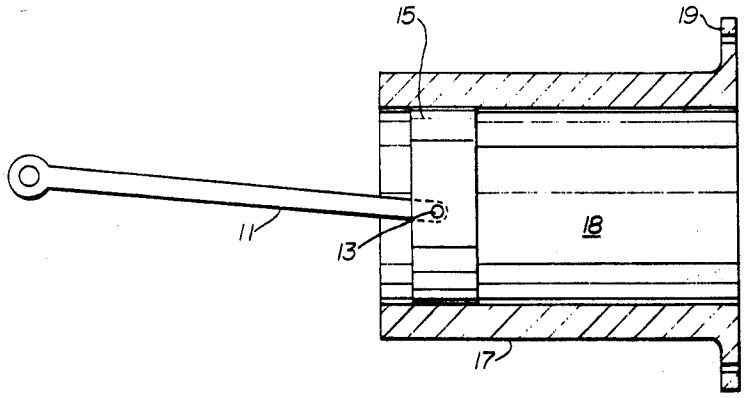
FIG. 1 is a schematic section view of a reciprocating element suitable for generating low-frequency high-power mechanical wave energy.

For the generation of relatively low-frequency high-power mechanical wave energy, a reciprocating piston driven by a source of rotary mechanical energy is suitable. FIG. 1 schematically illustrates such an energy source comprising a connecting drive rod 11 pivotally connected by wrist pin 13 to piston 15 slideably and sealingly mounted for reciprocating motion within cylindrical sleeve 17, which is provided with a flange 19 for connection to an adjoining energy transmission device, which can simply be a length of solid metal pipe. The walls of the sleeve 17 should also be constructed of solid metal or the like to avoid absorption of mechanical wave energy. A working liquid 18 is present in the cylinder 17 to the right of piston 15. The sleeve 17 and adjoining pipe segments act as a conduit for mechanical wave energy, and if the walls 17 and the walls of the adjoining pipe line are smooth and unyielding, the mechanical wave energy will be substantially confined to pressure variations in the fluid within the conduit, and will not be appreciably absorbed by the pipe walls.

The relevant parameters of the liquid 18 in the mechanical wave energy generator may not be completely satisfactory for the transmission or radiation of that energy. Mechanical wave energy transformers suitable for changing some of the characteristics of the mechanical wave energy may be provided as required. Three different types of transformer are illustrated in FIGS. 2, 3 and 4.

Figure 2:
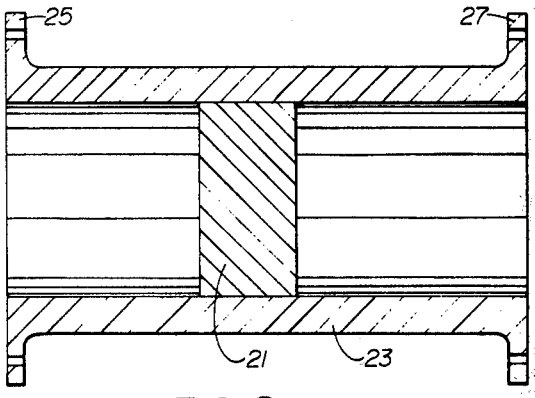
FIG. 2 is a schematic section view of a piston coupling element suitable for use as a transformer of low-frequency high-power mechanical wave energy.

In FIG. 2, the transformer comprises a piston 21 slideably mounted within a solid metal cylinder 23. The ends of the cylinder 23 are provided with flanges 25, 27 for connection to adjoining pipe sections or the like. It is contemplated in use of the transformer of FIG. 2 that a liquid having one set of physical characteristics will occupy the space to the left of the piston 21 and that a liquid having a different set of physical characteristics will occupy the space to the right of the piston 21, the density, viscosity and other relevant characteristics of the two liquids being selected to couple the mechanical wave input to the mechanical wave output as required.

Figure 3:
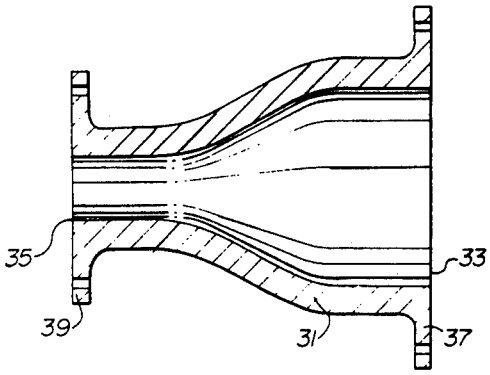
FIG. 3 is an alternative fluid coupling device suitable for use as a mechanical wave energy transformer.

The transformer of FIG. 3 is suitable where the working liquid has the desired physical properties but where the diameter of the input element does not accord with the diameter of the output element. In this case, all that is required is a tapering pipe section 31 having a wide diameter terminating end 33 and a narrow diameter terminating end 35. A wide diameter flange 37 is provided adjoining the wide diameter end 33 for coupling to an adjacent wide diameter pipe section or the like, and a narrow diameter flange 39 is provided adjacent the narrow diameter end 35 for connection to adjoining narrow pipe sections or the like.

Figure 4:
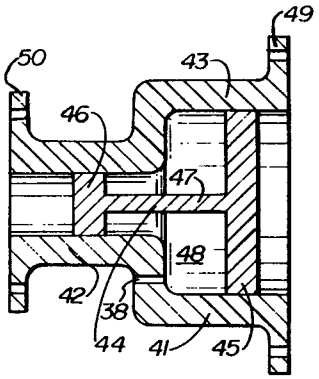
FIG. 4 is a further alternative fluid coupling device suitable for use as a mechanical wave energy transformer.

FIG. 4 illustrates a transformer suitable for accommodating the situation in which both the pipe diameter and the working liquid require to be varied. In this case a cylinder 41 is provided having a narrow-diameter cylindrical portion 42 and a wide-diameter cylindrical portion 43. A double piston element 44 is provided, having a wide-diameter piston 45 slideably mounted in wide-diameter cylindrical portion 43 of cylinder 41, and a narrow-diameter piston 46 slideably and sealingly mounted in narrow-diameter cylindrical portion 42 of the cylinder 41. The two pistons 45, 46 are interconnected by a solid connecting rod 47 which may be integral with the two pistons 45, 46. The space 48 between the pistons 45, 46 may be evacuated or vented to the outside air, as by vent 38. The physical properties of any fluid 48 between the pistons 45, 46 should be taken into account in determining the characteristics of the transformer. The cylinder 41 may be provided with wide-diameter flange 49 and narrow-diameter flange 50 for the purpose of permitting connection to adjoining pipe segments or the like.

Figure 5:
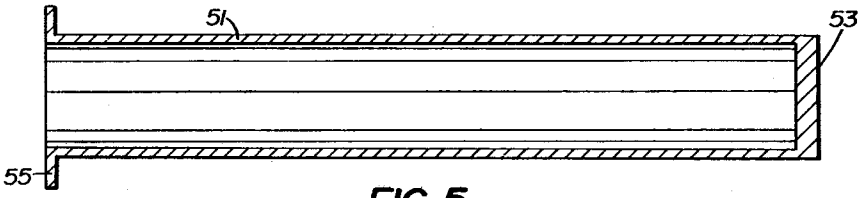
FIG. 5 is a schematic section view of a high-power low-frequency mechanical wave energy radiator in accordance with the teachings of the present invention.

A suitable mechanical wave energy radiator for radiating mechanical wave energy uniformly and with circular symmetry about its axis of revolution is illustrated in FIG. 5. The radiator comprises a circular cylindrical tube 51 terminated by a rigid end wall 53. The tube 51 is also provided with a flange 55 for connection to an adjoining section of the sonic energy transmission line. The walls of the cylindrical tube 51 are sufficiently thin and may be dimpled or otherwise surface-modified to enable the tube 51 to oscillate radially in response to the pressure variations within the liquid contained by the tube 51. The pressure variations arise from the transmission of sonic energy from the adjoining transmission line. The tube 51 may be of strong, relatively thin stainless steel, for example. The length of the tube 51 from the flange 55 to the terminating rigid end wall 53 should be an odd multiple of a quarter wavelength of the mechanical wave energy being radiated. This is a condition for end-to-end resonance in a liquid. The thickness of the side walls and the material out of which they are made, and the density of the liquid within the tube 51 will determine other significant physical characteristics of the radiator, although the nature of the fluid in which the radiator is immersed will also affect the radiation characteristics. The tube 51 will be expected to be several times longer than its diameter; the preferred ratio in any practical application is best determined empirically.

Figure 6:
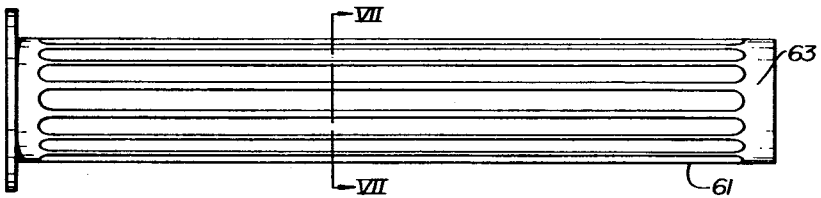
FIG. 6 is a schematic elevation view of an alternative embodiment of a mechanical wave energy radiator in accordance with the teachings of the present invention.
Figure 7:
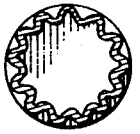
FIG. 7 is a cross-section view along the line VII—VII of FIG. 6.

FIG. 6 illustrates an alternative form of radiator in accordance with the teachings of the present invention. This radiator comprises an extended cylindrical tube 61 again terminated by an end wall 63 which departs from a circular cylinder by virtue of corrugations along the length of the tube 61. These corrugations can be clearly perceived in the section view of FIG. 7. The corrugations facilitate radial deflection of the walls of the tube 61, which walls can be made of thin stainless steel or the like as described previously with reference to FIG. 5.

Maximum radiation efficiency of the radiator of either FIG. 5 or FIG. 6 depends upon the achievement of resonance. The length of the liquid column in the tube 51 or 61, the density of the contained liquid, and the wall stiffness are the principal factors determining the resonant frequency. If the walls are relatively stiff, the length of the tube is expected to be the principal factor determining the resonant frequency, and to this end, the length should be an odd multiple of a quarter wavelength at the frequency of mechanical energy supplied. If, however, the walls of the radiator have relatively low stiffness, the density and compressibility of the contained liquid and of the external fluid may be paramount parameters. The correct interrelationship of these parameters for any particular application will probably be determined empirically, since the theoretical predictions are difficult to reach and to translate into practical application.

Figure 8:
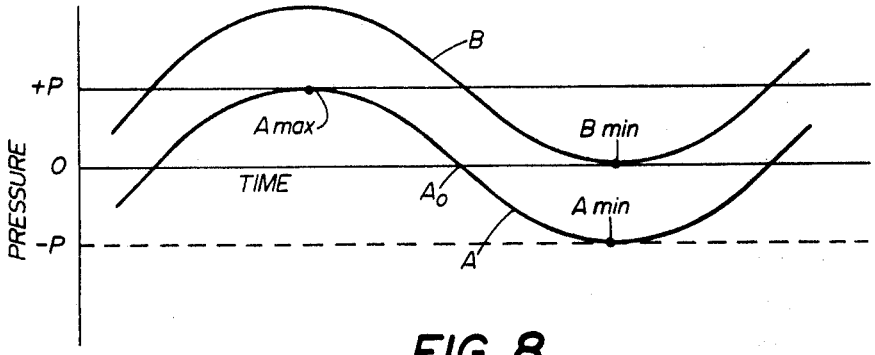
FIG. 8 is a pressure-versus-time diagram illustrating the effect of a constant pressure bias on a mechanical wave generated in a liquid.

It is desired of course to have substantially all of the energy generated by the reciprocating source or other suitable energy source delivered to the radiator without appreciable loss and then transmitted by the radiator to the surrounding medium. A certain amount of the mechanical wave energy can be dissipated undesirably internally as heat if as a consequence of the pressure variations in the liquid medium within the transmission system, vapor-filled bubbles are permitted to form and collapse. This formation and collapse of vapor filled bubbles, referred to as "cavitation," can dissipate large amounts of energy. The problem exists because at any point in the liquid in the transmission line, pressure variations may, unless precautions are taken, generate an apparent "negative pressure" which can permit vapor bubbles to form in the fluid. These vapor bubbles are generated during periods of rarefaction and collapse during periods of compression of the liquid at any point in the system. This phenomenon is graphically illustrated in FIG. 8, which shows that at any point in the liquid transmission line the pressure rises and falls (e.g. sinusoidally if a reciprocating energy source is used) cyclically over a period of time, as represented by curve A in FIG. 8. During periods of minimum pressure $A_{min}$ vapor bubbles tend to form; during periods of maximum pressure $A_{max}$ these bubbles tend to collapse. If the periods of minimum pressure $A_{min}$ give rise to a pressure $-P$ with reference to the steady state pressure $A_O$ in the system, it follows that if the total system pressure were increased by a bias pressure P, the resulting pressure-versus-time curve at any point in the system would be represented by curve B of FIG. 8, and that the lowest pressure $B_{min}$ would be equal to the steady state pressure $A_O$ of the system at rest. Since gas or vapor bubbles will not form spontaneously in the liquid present in the system at rest (or in any event the liquid can be chosen so that this is true), it follows that increasing the steady state pressure in the transmission line by a bias pressure P will avoid the problem of cavitation.

Figure 9:
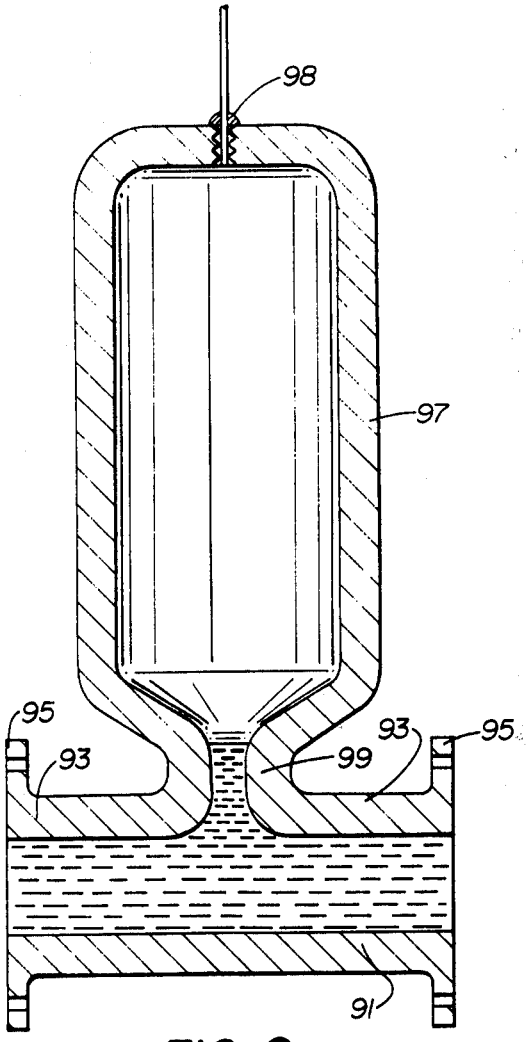
FIG. 9 is a schematic section view of a bias pressure source for use in accordance with the transmission of mechanical wave energy in accordance with the teachings of the invention.

Accordingly, means for the application of a gas under at least a pressure P to the liquid transmission system may take the form illustrated in FIG. 9. A pipe coupling element 91 has circular cylindrical end portions 93 terminating in coupling flanges 95 for connection to adjoining pipe sections and the like. A gas pressure chamber 97 communicates with the liquid in the transmission line by means of a constricted conduit 99. The gas chamber 97 should of course be placed above the liquid transmission line to avoid escape of gas into the confined liquid. The chamber 97 may be provided with a suitable gas supply inlet 98 by means of which the gas pressure within the chamber 97 can be varied. The inlet 98 should be of very small diameter so as to avoid sonic energy losses therethrough. The constriction 99 should also be small so as to minimize the interruption of continuity of the reflective pipe surface and to minimize radiation into the gas chamber 97.

Cavitation can also be avoided by selecting as the working liquid one having a low vapor pressure and little or no dissolved gas or suspended solid particles.

Selected ones of the above-described components can be arranged to cooperate for the mechanical wave heating of petroleum residues and the like. An exemplary extraction site and apparatus for the mechanical wave heating of such residues are illustrated schematically in FIG. 10.

A source of rotary mechanical energy schematically illustrated by element 101 is connected by crank 103 to a reciprocating piston 105 slideably mounted in cylinder 107. The cylinder 107 is coupled to a pipe section 109 connected by a conduit 111 to a gas pressure chamber 113 which exerts a bias pressure on the liquid (e.g. water) contained in the transmission line 115 within the interior of the interconnected pipe sections. The initial transmission line portion is fairly wide (thus permitting the piston 105 to have a relatively short stroke) but for long distance transmission, a narrower pipe section 117 may be preferred. For that purpose a transformer coupling element 119 is optionally provided to narrow the transmission line to the diameter convenient for long distance transmission, if that is necessary.

Figure 10:
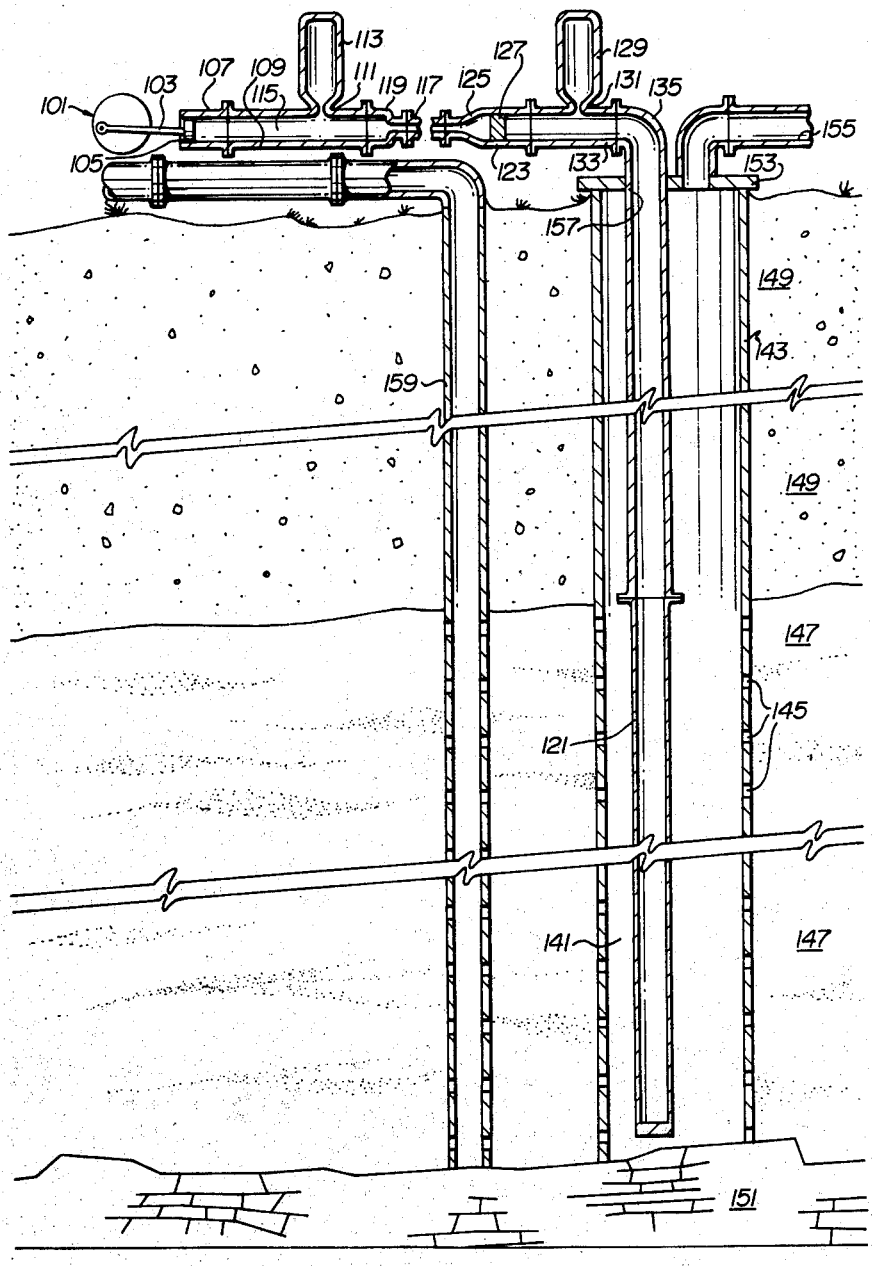
FIG. 10 is a schematic section view of an exemplary generation, transmission and radiation system for heating of petroleum residues by high-power low-frequency mechanical wave energy in accordance with the teachings of the present invention.

At the radiating end of the system, let us assume that it has been empirically determined that the radiator 121 requires to operate at a diameter wider than the pipe section 117 and with an internal fluid other than water. Accordingly, a transformer section 123 is provided containing both a diverging tapered section 125 and a sliding piston 127 which permits both a widening of diameter and a change in the transmitting fluid. A separate gas chamber 129 connected by a small orifice 131 to pipe section 133 is provided in order to ensure that there is a bias pressure operating on the working fluid for the radiator 121. It may be observed that the system of FIG. 10 is also provided with an elbow portion 135; the provision of such elbow portion should normally be possible without substantially interfering with the transmission efficiency of the system.

If the reciprocating source produces mechanical wave energy at a frequency of 60 Hz, and glycerine is the working liquid, the wave velocity will be about 1900 meters per second, and the wavelength about 32 meters. Thus the radiator should be of the order of 8 meters in length, or some odd multiple of this (the exact length preferably being empirically determined, or the frequency of the source adjusted to produce resonance).

The mechanical wave radiator 121 is located within a well shaft 141 provided with a casing 143 having perforations 145 throughout that portion of its length located adjacent a petroleum residue layer 147 situated between an over-burden layer 149 and a basement rock layer 151. The well casing 143 is sealed at the top by a well cap 155 into which the mechanical wave energy transmission line section 157 and an extraction pipe 155 are fitted. In some cases the layer 147 may partially be comprised of water, if water has previously been used to facilitate extraction of petroleum. The presence of such water should not adversely affect the untilization of the heating technique according to the invention. The mechanical wave radiator 121 should preferably be long enough to span the thickness of the petroleum deposit, the radiator parameters being adjusted to give resonance for the selected length at the operating frequency. If necessary, oil may be introduced via extraction pipe 155 into the well shaft 141 so that the radiator 121 has intimate and uninterrupted coupling through a liquid medium to the surrounding formation. The mechanical wave energy will be directed into the petroleum residue in the three-dimensional pattern characteristic of the radiator configuration, modified by the reflections from the upper and lower boundaries of the deposit, where abrupt discontinuities in wave velocity may be expected. Virtually all the radiated energy is expected to be dissipated in the petroleum deposit and it will be heated at a rate proportional to the radiator output. As the cylindrical mass coaxial with and close to the radiator 121 becomes raised sufficiently in temperature, and becomes fluid its attenuation of the wave energy will decrease, and the energy penetration will increase. The fluid petroleum can then be pumped to the surface.

One or more injection wells 159 may be provided at a distance from the extraction well 141, and used to inject steam, water, air, or (to avoid combustion) an inert gas, under pressure, into the petroleum formation, to facilitate expulsion of the petroleum from the well 141 via extraction pipe 155. It is important to note, however, that the mechanical wave energy can be effectively propagated only through a liquid or solid medium, not through a gas. Therefore, if there is a danger that injected gas could permeate the underground deposit before it has been sufficiently fluidized, a liquid (e.g. water) rather than a gas may be injected via injection wells 159. During the extraction operation, heating by mechanical wave energy can be continued or not, as empirically determined. If water is injected into the formation, it is preferably pre-heated at the surface so that the mechanical wave energy is not wasted by heating water. However, mechanical wave energy attenuation by, and consequently the heat absorption of, the injected water, is expected to be relatively small.

It is conceivable that in some cases the in situ heating of the petroleum should be continued to temperatures sufficient to cause vaporization or gasification, cracking, and re-gasification of the petroleum, or portions thereof, with the gaseous hydrocarbon products conducted to surface storage or processing facilities via extraction pipe 155.

When mechanical wave energy is transmitted from the generator 101 to the radiator 121, the energy is transmitted into the surrounding medium, in a pattern determined by the radiation characteristics of the radiator 121, and the relative velocity of the waves in the petroleum deposit and in the rocks above and below this layer. These velocities will ordinarily differ widely, the velocity in the petroleum deposit being of the order of one-fourth the velocity in typical rocks, so that the waves radiated into the petroleum layer are reflected from the rock layers above and below, and the energy is largely confined to the petroleum layer.

The waves are propagated with small attenuation, and therefore small energy dissipation, through the oil or other liquid medium surrounding the radiator 121, and with higher energy dissipation in the viscous petroleum residue surrounding the borehole. This energy dissipation heats the petroleum and reduces its viscosity at temperatures possibly as low as 200° F but probably considerably higher. When it becomes sufficiently fluid, its attenuation decreases markedly, and the wave energy passes increasingly freely through it to the more viscous material beyond. In this way the wave energy heats and liquefies a cylinder of constantly increasing diameter, and when this diameter reaches a desired value, gas or water under appropriate pressure may be introduced into the injection well 159, to facilitate extraction of the molten material to the surface. If the extraction process leaves a cavity around the well shaft and it is desired to continue operations at the same site, the cavity from which the petroleum has been extracted can then be flooded with water, and the heating process re-commenced. Since the water has a relatively low attenuation factor, the mechanical wave energy is mostly transmitted to the remaining surrounding petroleum layer. As this is heated to fluidity, the diameter of the molten annulus constantly increases. When desired, this mass can be educted to the surface, to be processed there, the cavity filled with water, and the heating cycle again repeated. It will be apparent from the above discussion that the present invention may be useful in other situations in which the viscosity of underground hydrocarbon deposits is required to be lowered by heating, as in the case of naturally occurring deposits of heavy oil or bitumen, viscous mixtures of oil with other materials (e.g. sand), etc. In such other cases, a suitable well may of course have to be sunk.

Modifications and variations of the foregoing proposals will occur to those skilled in the art. The scope of the invention is to be ascertained by the appended claims.

What we claim is:

1. The mechanical wave heating in situ of a selected portion of an underground deposit of hydrocarbons by means of a mechanical wave radiator immersed in a fluid medium which is in direct contact with the said selected portion and located in a well communicating with said selected portion of the deposit, the radiator transmitting mechanical wave energy to the selected portion of the deposit until the selected portion becomes fluid, the said radiator comprising a tube for containing a liquid medium for transmitting mechanical waves, said tube being closed at one end and having connecting means at the other end for connection to a source of mechanical waves, said tube having side walls made of elastic material suitably formed for oscillatory deflection in response to the application of mechanical waves from said source to said liquid medium.

2. The method of claim 1, additionally comprising drawing off fluid hydrocarbons from the well.

3. The method of claim 2, wherein the deposit comprises the viscous residue adjacent or at least partially within a conventional oil well which has been at least partially exhausted.

4. The method of claim 2, additionally comprising injecting a fluid under pressure into the hydrocarbon deposit to promote the drawing-off of fluid hydrocarbons from the well.

5. The method of claim 2, wherein the mechanical wave energy is supplied by a mechanical wave transmission system comprising a. a source of mechanical wave energy, and b. a transmission line for transmission of mechanical wave energy comprising an enclosed liquid medium coupled at one end to said source of mechanical wave energy and at the other end to the radiator.

6. A method as defined in claim 5, wherein the source of mechanical wave energy is a reciprocating piston working in a cylinder coupled on the output side of the piston to said liquid medium.

7. A method as defined in claim 6, additionally comprising a source of pressure coupled to said liquid medium for application of a bias pressure thereto.

8. The method of claim 1, wherein the side walls of the tube are generally of circular cylindrical form.

9. The method of claim 8, wherein the closed end of the shell comprises a rigid plane wall generally perpendicular to the cylindrical axis of the tubular shell.

10. The method of claim 9, wherein the side walls of the tube are of overall circular cylindrical form but are provided with corrugations extending parallel to the cylindrical axis of the tube.

11. The method of claim 9, wherein the side walls and closed end of the tube are made of metal, the closed end being of relatively thick unyielding metal for reflecting mechanical wave energy and the side walls being of relatively thin metal for transmission of mechanical energy to the external medium surrounding the radiator.

12. The method of claim 11, wherein the axial length of the tube is substantially greater than its diameter, and wherein the axial length is selected to be an odd multiple of one-quarter wavelength of the mechanical waves supplied by the source.

13. The method of claim 12, wherein the connecting means comprises an opening for connection of the tube to an enclosed liquid medium for transmission of mechanical wave energy.

* * * * *